US005606334A

United States Patent [19]

Amarillas et al.

[11] Patent Number: 5,606,334

[45] Date of Patent: Feb. 25, 1997

[54] INTEGRATED ANTENNA FOR SATELLITE AND TERRESTRIAL BROADCAST RECEPTION

[76] Inventors: Sal G. Amarillas, 6404 Salizar Ct., San Diego, Calif. 92111; Edwin D. Bowen, 17523 Rancho De Oro Dr., Ramona, Calif. 92065; Frederick J. Verd, 2160 Alpine Glen Pl., Alpine, Calif. 91401

[21] Appl. No.: 410,907

[22] Filed: Mar. 27, 1995

[51] Int. Cl.[6] ..... H01Q 19/12

[52] U.S. Cl. ..... 343/840; 343/753; 343/755; 343/914

[58] Field of Search ..... 343/753, 755, 343/781 P, 781 CA, 909, 914, 840, 725, 727; H01Q 19/12

[56] References Cited

U.S. PATENT DOCUMENTS

| | | | |
|---|---|---|---|
| 2,677,056 | 4/1954 | Cochrane et al. | 343/755 |
| 2,728,912 | 12/1955 | Wells | 343/755 |
| 4,194,209 | 3/1980 | Coulbourn | 343/753 |
| 4,513,293 | 4/1985 | Stephens | 343/914 X |
| 4,673,945 | 6/1987 | Syrigos | 343/755 |
| 4,769,646 | 9/1988 | Raber et al. | 343/753 |
| 4,804,970 | 2/1989 | Todd | 343/909 X |
| 4,825,223 | 4/1989 | Moore | 343/840 |
| 5,257,032 | 10/1993 | Diamond | 343/727 X |
| 5,300,936 | 4/1994 | Izadian | 343/727 X |
| 5,434,580 | 7/1995 | Raguenet et al. | 343/725 X |

FOREIGN PATENT DOCUMENTS

| | | | |
|---|---|---|---|
| 0022403 | 4/1984 | Japan | 343/753 |

OTHER PUBLICATIONS

The New Age of Earth Station Technology by Karen JP Howes, Via Satellite, May 1994, pp. 42, 44, 46.

*Primary Examiner*—Donald T. Hajec
*Assistant Examiner*—Tho Phan
*Attorney, Agent, or Firm*—Gilliam Duncan & Harms

[57] ABSTRACT

A compact and flat antenna that provides both Direct Broadcast Satellite and local off-air reception. The flat reflector is made of a composite material with multiple reflective radiating surfaces. The multi-stepped reflector combines both diffraction and refractive principals to collimate Radio Frequency signal waves to a short focal point. At the focal point a phase correcting splash plate and lens direct the RF signal through a low loss axis-fed circular waveguide and then to a low noise amplifier. This compact design reduces space, cost and over-all structure, which presents an aesthetically pleasing satellite communication antenna. The antenna aperture includes a VHF/UHF antenna element for reception of local and/or off-air broadcast TV signals eliminating the need and cost to install a separate antenna.

15 Claims, 5 Drawing Sheets

INTEGRATED ANTENNA FOR SATELLITE AND TERRESTRIAL BROADCAST RECEPTION

BACKGROUND OF THE INVENTION

1. Field of the Invention

This invention relates generally to radio wave communications antennas, and more specifically to a flat reflector antenna for satellite signal reception as well as local radio and television reception.

2. Description of Related Art

Typical direct broadcast satellite (DBS) reception systems currently employ parabolic dish antennas that are both bulky and not aesthetically pleasing. Furthermore, these systems are not able to receive radio and TV signals of local origin. In order to improve the aesthetic character of satellite antenna systems, low profile or "flat-dishes" have been developed, however, previous low profile DBS antennas have been deficient in important RF performance parameters such as for example, gain, low sidelobes, high cross-polarization isolation, and also in necessary mechanical features such as structural integrity and light weight. These devices, due to their complexity, have not been able to be produced at the low cost required for broad commercial success.

As an example of the foregoing, attempts continue in the development of a low profile, high gain flat antenna to achieve acceptable satellite TV signals. Various flat antenna designs using printed circuit, Fresnel zone reflectors and phased array antenna technologies have been tried. Printed circuit flat antennas are limited in bandwidth, aperture efficiency, cross polarization isolation and have high manufacturing cost. Flat phased array antenna designs exhibit very low aperture efficiency, typically in the range of approximately 30–37% versus a high of 70% for an off-set parabolic dish antenna. This type of antenna design also exhibits very poor cross-polarization isolation and high production costs. Fresnel zone plate antennas, which are essentially flat, have not been able to adequately meet all the previously mentioned antenna parameters. The most important limitations of these antennas are primarily related to the above mentioned loss of performance and poor gain.

A flat antenna is disclosed in *C100: Tsiger Planar Antenna* a technical description from Tsiger Planar Inc. of Colorado Springs, Colorado. This device is 65 inches square by only 2.5 inches in thickness, and weighs 65 pounds. It is a combination Fresnel lens and zone plate of a design not yet disclosed nor having patents issued. Further, of interest in the matter of flat antennae is an article entitled, *The New Age of Earth Station Technology* published in *Via Satellite,* May 1994. No prior art has been found which discloses a combination of multi-stepped reflectors, axis fed, lens corrected splashplate feed with VHF/UHF antenna combined elements for the simultaneous reception of satellite and local station off-air broadcast signal reception of high quality.

The present invention fulfills these needs and provides further related advantages as described in the following summary.

SUMMARY OF THE INVENTION

The invention is a combination satellite and local broadcast receiving antenna. It comprises a satellite wave reflector, a feed assembly, a satellite low noise amplifier, and a local broadcast VHF-UHF antenna and low noise amplifier. The principal object of the invention is to provide a low profile, flat and compact antenna especially suited to DBS reception with improved cross polarization isolation, low sidelobes, high gain efficiency, low cost, high reliability and low susceptibility to RF interference. A further object of the invention is to provide such an antenna with the additional capability of receiving VHF-UHF broadcasts of terrestrial origin.

These and other objectives are achieved by providing a multi-stepped reflector antenna which provides optimal results in individually focusing the incoming satellite parallel rays to a common focal point, while assuring that all reflections are in phase. The reflector consists of multiple parabolic reflective surfaces, all of which are arranged for radiating in phase using one wavelength stepped transitions. These transitions are the phase corrections required to focus each surface to a common focal point. The phased matched steps between the reflecting surfaces are the basis for improved efficiency in the design. The use of step-chokes or quarter wave chokes incorporated in the shadow areas between successive surfaces, control edge scattering in each successive reflecting surface. They reduce electromagnetic energy scattering at the step discontinuities, thereby improving the overall reflection efficiency. The one half wavelength steps provide immunity to terrestrial interference. Various types of corrections are feasible with this antenna. These include satellite and transponder distortion characteristics, satellite propagation characteristics, frequency compression digital coding characteristics and time delay distortion.

A Cutler feed is used in the invention as a mode converter. It changes the direction of the wave returning it to the reflector so as to control the pattern of the feed. A dielectric insert reduces the size of the aperture of the waveguide by dielectric loading. The reduced waveguide and splashplate size, reduces the size of the dead zone at the center of the main reflector. A dielectric lens provides additional efficiency of collection of the reflector. The wave guide can carry either vertically or horizontally polarized energy, or it can carry both polarizations simultaneously to obtain any sense or orientation of received polarization. The feed has excellent cross-polarization isolation and is optimized for the aperture area which preferably uses a 4–10 decibel selectable edge taper and provides equal E-plane and H-plane illumination. The feed and wave guide assembly interfaces directly with a satellite low noise amplifier (LNA) positioned behind the reflector. It provides for polarization selection and optimization, and also alignment through selection of components and by simply rotating the feed assembly within the stationary reflector. The local VHF-UHF LNA provides active summing of the individual off-the-air antenna elements and increases the systems gain-to-temperature ratio to improve off-the-air reception of local broadcast stations.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the invention. In such drawings.

DETAILED DESCRIPTION OF THE PREFERRED EMBODIMENT

FIGS. 1–6 show an integrated antenna system designed to provide a low profile, relatively flat and compact antenna especially suited to Direct Broadcast Satellite reception, as well as receiving broadcasts of terrestrial origin. The present inventive integrated antenna system has improved cross polarization isolation, low sidelobes, high gain efficiency and low susceptibility to Radio Frequency interference. It has a size significantly more compact than standard parabolic dish antenna systems, thus making it more aesthetic, more practical and less expensive to manufacture. The present system is highly reliable and much more efficient than standard systems.

Figure 1:
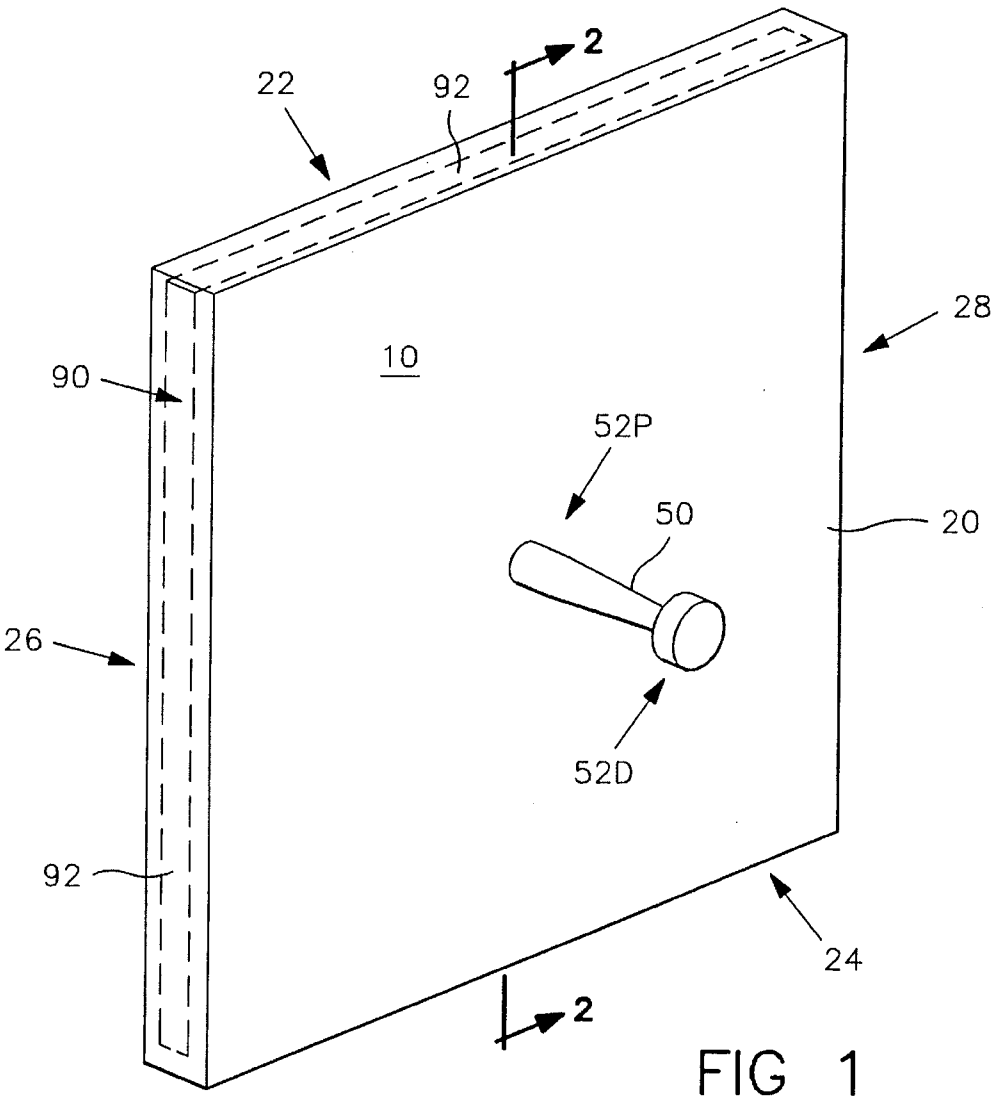
FIG. 1 is a perspective view of a preferred embodiment of the present invention, particularly showing a flat wave energy reflector, and feed assembly.
Figure 3:
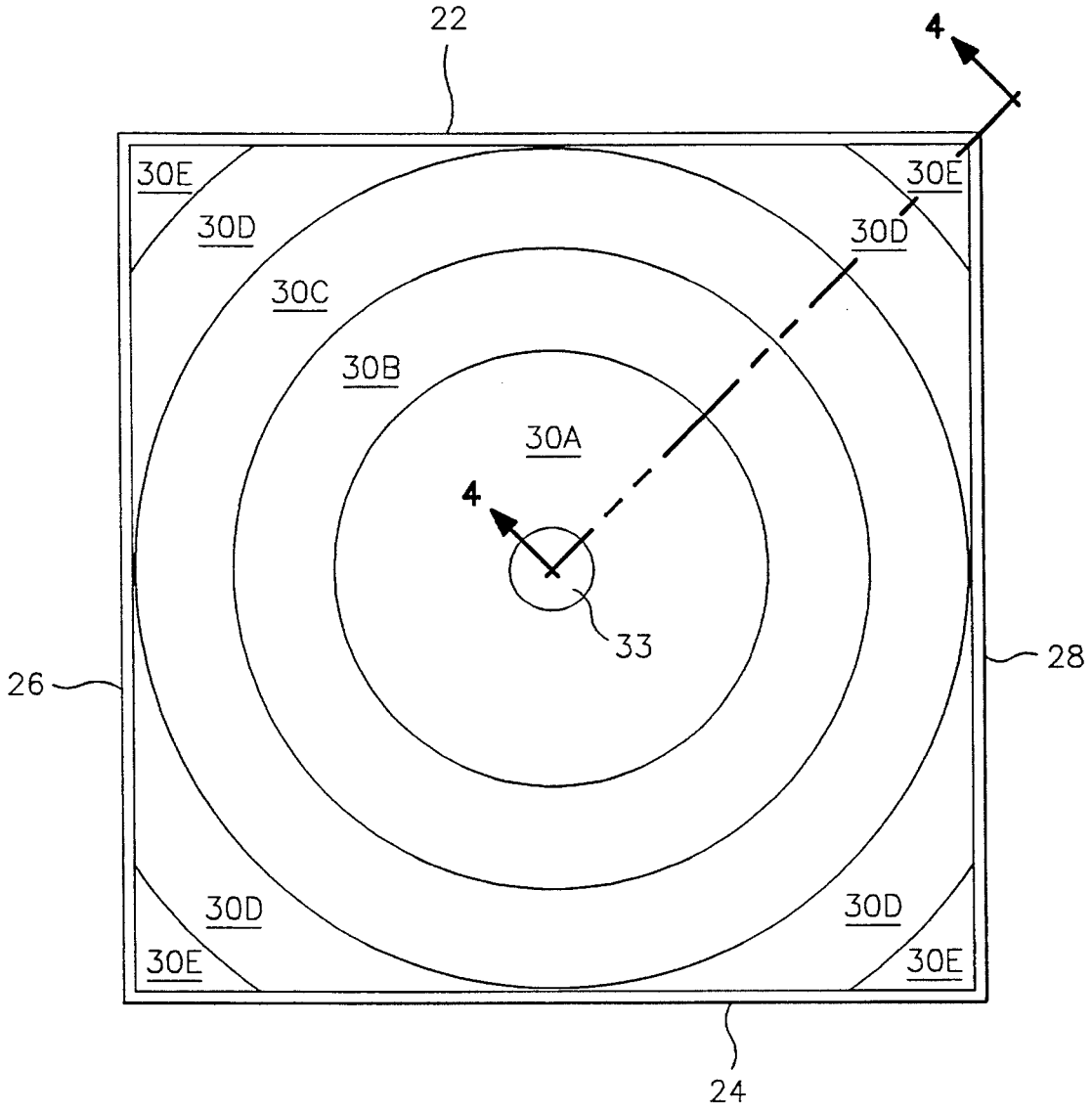
FIG. 3 is a front elevational view of the reflector shown without the cover plate and the feed assembly, particularly showing the positions of concentric parabolic surfaces of the invention.

The antenna system generally consists of a low profile satellite wave reflector 20, a round waveguide 50, a splash plate 60 and dielectric lens assembly 70, means for satellite signal amplification 80 and a VHF-UHF noise amplifier 85. As illustrated in FIG. 1, the low profile reflector 20 is square in shape and provides a top 22, a bottom 24, a left 26, and a right edge 28 which define the lateral extent of the reflector 20. The reflector 20 also provides a composite outfacing surface 25 and infacing surface 27. The infacing surface 27 is generally flat, while the outfacing surface 25 is composed of a series of microwave reflecting concentric, circular, near-abutting, parabolic subsurfaces 30A–E which are best seen in FIG. 3. As illustrated, the reflector 20 includes five parabolic subsurfaces 30A–E, but the reflector is by no means limited to this number of subsurfaces.

Figure 2:
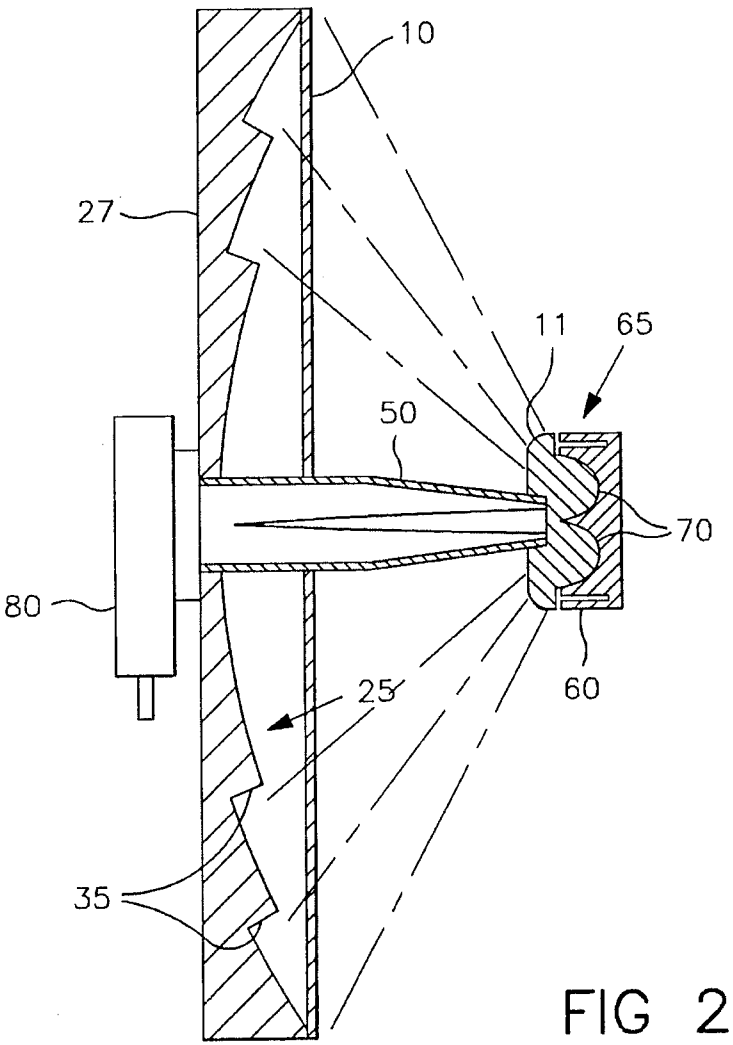
FIG. 2 is a cross-sectional view taken along line 2—2 of FIG. 1 providing further details of the invention.

Each subsurface 30A–E is separated from each adjacent subsurface by an annular step 35 (FIG. 2). This configuration effectively positions the subsurfaces 30A–E in a relatively flat arrangement. Each of the parabolic subsurfaces is an annular section of a parabolic dish, and each is shaped and positioned so as to define a common focal point for the reflector 20 as a whole. The multi-stepped reflector 20 combines both diffraction and refractive principles to collimate RF signal waves to a short focal point. The focal distance of the subsurfaces is significantly shorter than a comparable focal distance for a continuous parabolic dish antenna of comparable diameter.

Figure 4:
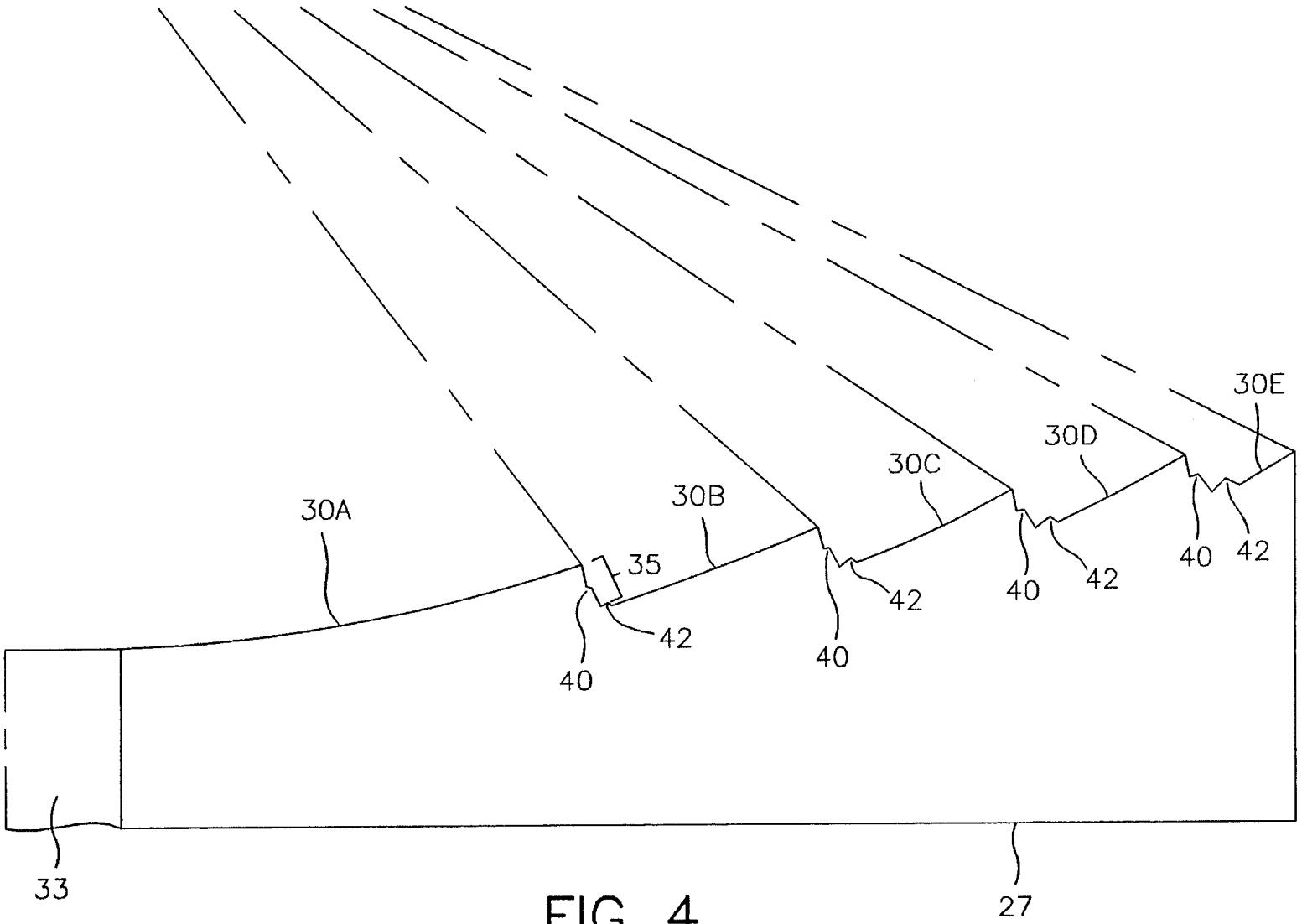
FIG. 4 is a cross-sectional view taken along line 4—4 of FIG. 3 particularly showing a preferred arrangement of concentric reflective surfaces in accordance with the principals of the invention, and further showing a preferred arrangement of quarter wave chokes defined between the surfaces.
Figure 5:
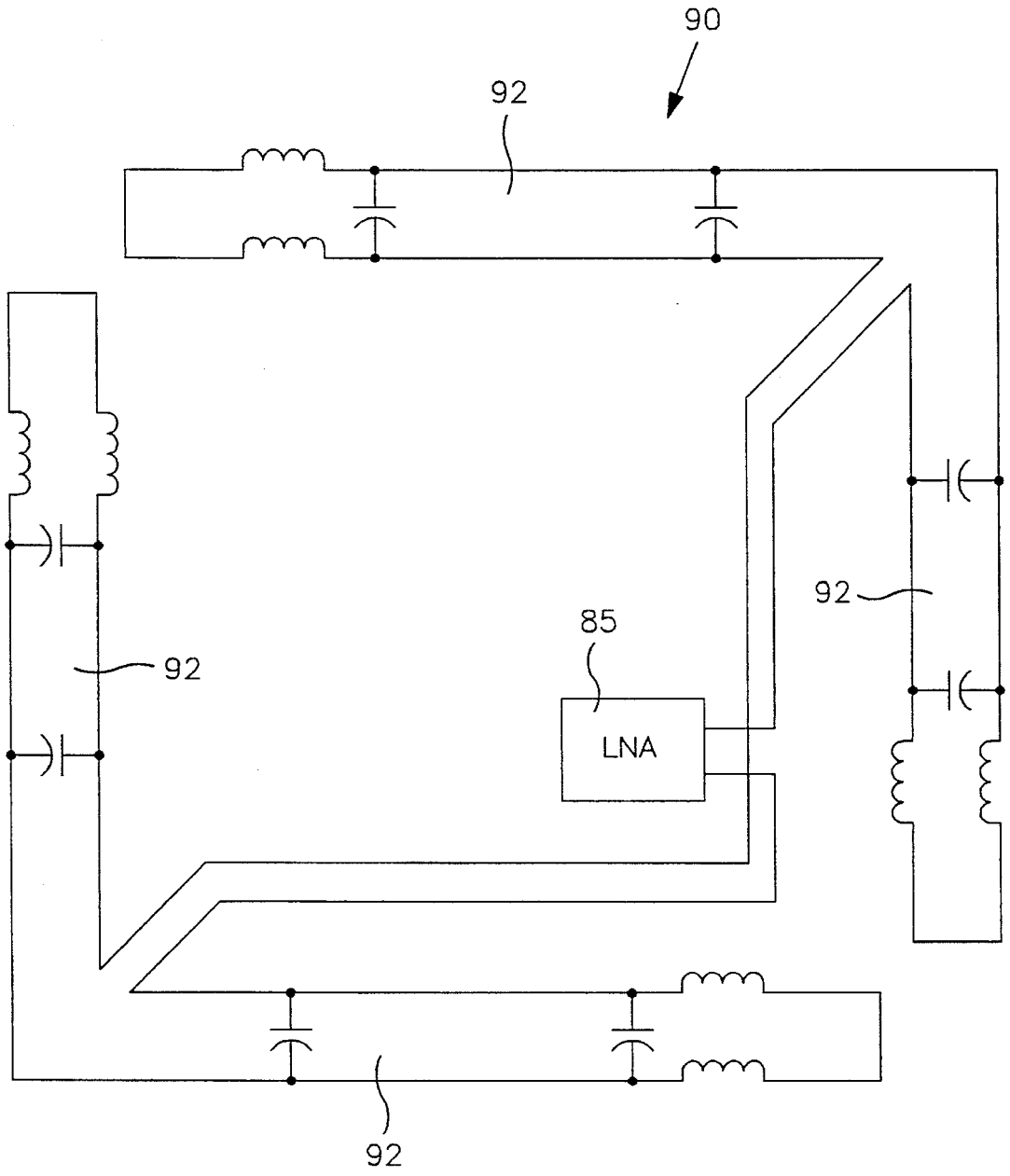
FIG. 5 is an electrical schematic diagram of a local radio and TV reception antenna of the invention, mounted at the edges of the reflector.

Each annular step 35 includes at least one annular substep 40 positioned at a quarter wavelength position (FIG. 4). The substep 40 provides a choke incorporated in the shadow areas between the reflecting surfaces that serves to control and reduce edge scattering in each successive reflecting subsurface. The substeps 40 reduce electromagnetic energy scattering in the annular steps 35, thus improving the overall reflection efficiency of the reflector 20. The suppression of terrestrial interference is provided by a set of additional substeps 42.

The height of each annular step 35 is equal to one wavelength of the carrier wave of the satellite signal. Thus, each two adjacent parabolic subsurfaces are separated by one wavelength of the carrier wave so that the parabolic reflective subsurfaces 30 A–E radiate in phase using one wavelength stepped transitions. These transitions are the phase corrections required to focus each reflecting surface to a common focal point. Ultimately then, the phased matched steps 35 between the reflecting surfaces are the basis for improved efficiency in the present inventive design. Whereas flat antennas may have only 30% reflection efficiency, the present integrated antenna system has approximately 60% efficiency.

The reflector 20 has a centrally located through hole 33, as best illustrated in FIG. 3. The hole is of a size and shape to allow the round waveguide 50 of the integrated antenna system to be inserted through the hole 33. The waveguide 50 has a proximal 52P and distal end 52D. As illustrated in FIG. 1, the proximal end 52P of the waveguide 50 is positioned in the hole 33, the waveguide 50 thus secured to the reflector 20 at a position central to the subsurfaces 30A–E while the open, distal end 52D of the waveguide 50 extends outwardly from the outfacing surface 25 of the reflector 20.

The splash plate 60 and the dielectric lens 70 assembly function as a feed system 65 of the invention. As best illustrated in FIG. 2, they are attached to the distal end 52D of the waveguide 50 in a position so as to intercept radio waves reflected in phase by the reflector 20 toward the focal point. Once they are intercepted, the dielectric lens 70 directs the radio waves into the waveguide 50. The waveguide 50, as is usual for common waveguides, can carry either vertically or horizontally polarized energy, or it can carry both polarizations simultaneously to obtain any sense or orientation of received polarization.

The waveguide 50 interfaces directly with the means for satellite signal amplification 80. The amplifier 80 is engaged with the proximal end 52P of the waveguide 50 so that it too is centered around the hole 33 in the reflector 20 and extends beyond the infacing surface 27 of the reflector 20. The amplifier 80 receives and amplifies the radio waves once they have been directed into the waveguide 50 by the feed system 65. The amplifier 80 provides for polarization selection and optimization and increases the gain-to-temperature ratio of the satellite signal. The amplifier 80 also provides active summing of the individual antenna elements and increases the systems gain-to-temperature ratio to improve off-the-air reception of local broadcast stations.

The combination VHF-UHF antenna 90 is provided so as to enable reception of local and off-air broadcast TV signals. Thus, the inclusion of the antenna 90 eliminates the need and cost to install a separate antenna. The antenna 90 includes the VHF-UHF means for amplifying 85 (FIG. 1), which is mounted on the reflector 20. The VHF-UHF antenna 90 has four leg elements 92. The antenna 90 is shown in FIG. 1 as dashed lines since the antenna legs 92 are mounted in the edges. As illustrated, each one of the leg elements 92 is supported within one of the edges 22, 24, 26 and 28 of the reflector 20.

As illustrated in FIG. 1, a first protective cover 10 is positioned over the outfacing surface 25 of the reflector 20 so as to keep the reflective subsurfaces 30A–E free of debris while also protecting them from damage or deterioration incurred during long term while also protecting them from damage or deterioration incurred during long term exposure. The cover 10 includes a centrally located hole through which the waveguide 50 extends. The cover 10 is preferably composed of a low dielectric foam material, a substance that is transparent to radio waves, thus allowing the antenna system to function while the cover 10 is positioned over the reflector 20.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. An integrated antenna system comprising:

a low profile reflector providing a composite outfacing surface comprising a series of concentric, circular, near abutting, parabolic subsurfaces, each one of said subsurfaces being separated from each adjacent one of said subsurfaces by an annular step so that the subsurfaces are positioned in a relatively flat arrangement and shadow areas located between the adjacent reflective subsurfaces, and further each of the parabolic subsurfaces being an annular section of a parabolic dish, shaped and positioned so as to define a common focal point and having a focal distance shorter than a comparable focal distance for a continuous parabolic dish antenna of comparable diameter;

reflection efficiency improvement means incorporated in said shadow areas to control electromagnetic edge scattering in each successive reflecting surface;

a wave guide fixed at a proximal end thereof to the reflector at a position central to the subsurfaces and extending outwardly therefrom and having an open distal end thereof; and a splash plate and a dielectric lens assembly attached at the distal end of the waveguide in a position to intercept radio waves reflected by the reflector toward the focal point, said assembly directing said radio waves and for amplifying same.

2. The system of claim 1 wherein the concentric parabolic surfaces are circular.

3. The system of claim 1 wherein each of the annular steps is one wavelength of the carrier wave of the radio waves in height thereby separating each two adjacent of the parabolic subsurfaces by said one wavelength.

4. The system of claim 1 wherein said reflection efficiency means incorporated in said shadow areas to control electromagnetic edge scattering comprises at least one annular substep positioned for each annular step, said at least one annular substep positioned at a quarter wavelength to provide a quarter wave choke whereby electromagnetic energy scattering in the annular steps as well as terrestrial interference is reduced.

5. The system of claim 1 wherein each of the annular steps includes at least one annular sub-step positioned at a one-half wavelength position to reduce susceptibility to terrestrial interference.

6. The system of claim 1 additionally comprising a VHF-UHF antenna mounted on said low profile reflector.

7. The system of claim 6 wherein the VHF-UHF antenna has four leg elements, each one of the leg elements being supported along one of the edges of the reflector.

8. The system of claim 1 wherein the reflector is square in shape and provides a top, a bottom, a left, and a right edges, said edges defining the lateral extent of the reflector.

9. The VHF-UHF antenna of claim 7 additionally comprising a low noise amplifier mounted on the reflector.

10. The system of claim 1 furthering comprising a cover for the reflecting surface of said reflector, said cover having a central aperture for said waveguide to pass therethrough.

11. The system of claim 10 wherein said cover is constructed of low dielectric foam material.

12. An integrated antenna system as defined in claim 1 additionally comprising:

a VHF-UHF antenna mounted on said low profile reflector whereby satellite signals and VHF-UHF signals can be received by a single antenna.

13. The antenna of claim 12 wherein said VHF-UHF antenna comprises a plurality of off-the-air antenna legs positioned adjacent to the edges of said antenna.

14. The antenna of claim 13 wherein said plurality of the off-the-air antenna legs number four.

15. The antenna of claim 12 additionally comprises a low noise amplifier externally mounted on the antenna.

* * * * *